United States Patent [19]

Loychuk

[11] Patent Number: 4,988,018

[45] Date of Patent: Jan. 29, 1991

[54] AEROSOL ADAPTER CLAMP

[75] Inventor: Terrence Loychuk, North Vancouver, Canada

[73] Assignee: Nozone Dispenser Systems, Inc., Canada

[21] Appl. No.: 355,198

[22] Filed: May 19, 1989

[30] Foreign Application Priority Data

Dec. 2, 1988 [CA] Canada ..... 584776

[51] Int. Cl.[5] ..... B67D 5/06

[52] U.S. Cl. ..... 222/183; 222/215; 222/386.5

[58] Field of Search ..... 222/95, 215, 183, 105, 222/386.5, 288; 285/921; 604/132; 128/DIG. 12

[56] References Cited

U.S. PATENT DOCUMENTS 4,222,499 9/1980 Lee et al. ..... 222/183

4,324,350 4/1982 Thompson ..... 222/386.5

*Primary Examiner*—H. Grant Skaggs

*Attorney, Agent, or Firm*—Klarquist, Sparkman, Campbell, Leigh & Whinston

[57] ABSTRACT

This invention is directed to a novel adapter clamp which can be used in an aerosol disperser. More particularly, this novel adapter clamp enables various aerosol spray nozzle systems to be connected to various constructions of aerosol containers utilizing various aerosol power systems. An adapter suitable or enabling a nozzle to be fitted to the top of an aerosol can comprising: (a) a ridge formed at the top of the adapter, the ridge being adapted to mate with a rim of an aerosol nozzle; (b) a lip formed on the exterior surface of the adapter at a location below the ridge the lip being adapted to mate with a rim surrounding the opening in the top of an aerosol can; and (c) a ledge at the base of the adapter extending to the interior of the adapter, the base ridge having an opening therein, and being adapted to receive in bearing support the upper region of a bladder system adapted to power a liquid containing aerosol container.

7 Claims, 4 Drawing Sheets

AEROSOL ADAPTER CLAMP

FIELD OF THE INVENTION

This invention is directed to a novel adapter clamp which can be used in an aerosol dispenser. More particularly, this novel adapter clamp enables various aerosol spray nozzle systems to be connected to various constructions of aerosol containers utilizing various aerosol power systems.

BACKGROUND OF THE INVENTION

The use of bladders as contents containers and propellants in aerosols is becoming more common, particularly since commonly used fluorochloro-carbon propellants have been shown to be harmful to the environment. Such bladders are filled by an awkward process utilising special valves supplied by the bladder manufacturers. A need has existed for a mechanism which can be used by all aerosol manufacturers with existing equipment and which can be used on any bladder and any aerosol can. Such a mechanism should be sufficiently versatile that it can be used for either "under the cap" filling or for "through the valve" filling.

Until recently, aerosols were pressurised by injecting the propellant through the valve at the top of the aerosol—a slow and inefficient process. Latterly, a process has been developed of filling aerosols with both working fluid and propellant under the "cap", in a pressurised environment. Unfortunately, this more modern efficient approach has not been available for filling bladder type aerosols. Such aerosols continue to be filled "through the valve".

SUMMARY OF THE INVENTION

The invention is an adapter that fits between the container can and the nozzle assembly of an aerosol. It can be used with a variety of types of bladder, and all conventional aerosol cans. It has two forms, one to be used with already existing cans, thus allowing the use of current stocks of aerosol cans with new bladder interiors, and the second, a construction that can be built into new cans at manufacture.

An adapter suitable for enabling a nozzle to be fitted to the top of an aerosol can comprising: (a) rounded ridge means formed at the top of the adapter, said ridge means being adapted to mate with a rim of an aerosol nozzle; (b) lip means formed on the exterior surface of the adapter at a location below the ridge means, said lip means being curved for form between it and the wall of the adapter a receptacle adapted to mate with a rim surrounding the opening in the top of an aerosol can; and (c) means at the base of the adapter extending to the interior of the adapter, said base means having an opening therein, and being adapted to receive in bearing support the upper region of a bladder system adapted to contain and power through the nozzle a liquid containing aerosol container.

An adapter as described wherein the adapter is generally of cylindrical shape. In the adapter the upper ridge means can be rounded. In the adapter the lip means can be curved to form between it and the wall of the adapter an aerosol cap rim receptacle.

An adapter as described wherein a groove is formed in the exterior circumference of the mid region of the adapter. In the adapter a ridge can be formed in the exterior surface of the mid-region of the adapter. The adapter can be formed of metal, metal and plastic, or plastic.

DRAWINGS

In drawings which illustrate various embodiments of the invention, but which should not be regarded as restricting the spirit or scope of the invention in any way:

DETAILED DESCRIPTION OF SPECIFIC EMBODIMENTS OF THE INVENTION

The adapter clamp of this invention fits between a conventional aerosol container can and an aerosol nozzle assembly. It can be used with a variety of types of bladder aerosol power systems coupled with conventional aerosol cans. The adapter clamp has two basic forms, one which can be used with existing aerosol cans, thereby permitting aerosol manufacturers to use conventional filling equipment and current stocks of aerosol cans, and a second which can be built into new aerosol cans during manufacture. The adapter clamp of the invention enables conventional aerosol filling equipment to be used for filling bladder powered aerosol cans without adaptation. It enables filling of the aerosol can to be performed in one step as is now utilised for filling conventional gas propellant aerosol systems. One form of the adapter clamp can also be used in association with a rubber bladder, protective inner liner tube aerosol propellant system which is a subject of a co-pending patent application Ser. No. 355,197 filed in the name of Terrance Peter Loychuk on May 19, 1989.

Figure 1:
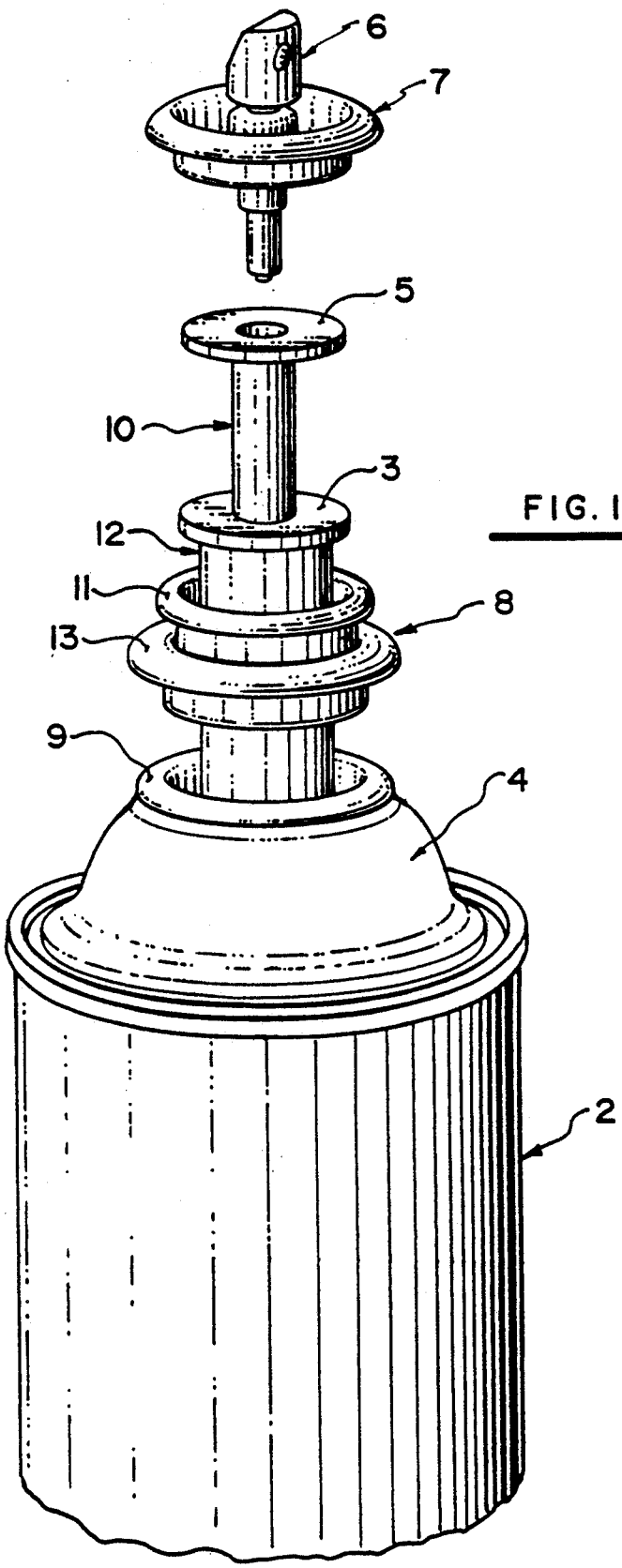
FIG. 1 illustrates an isometric exploded view of the components, including adapter clamp, which make up an aerosol power system utilizing a bladder aerosol generating mechanism.

Referring to FIG. 1, which illustrates an isometric exploded view of the components which make up an aerosol power system comprising a rubber bladder tube and an inner protective liner tube, it can be seen that the aerosol can 2 has mounted on the top thereof a conventional aerosol cap 4, with a curled cap rim 9. A conventional aerosol nozzle 6 is mounted on a spray top rim 7. A rubber bladder power tube 12, with a flange 3 at the top end thereof, has inserted therein a liner tube 10, which also has a corresponding flange 5 at the top thereof. The construction of the bladder tube 12 and the liner tube 10 are discussed fully in a co-pending patent application filed in the name of Terrance Peter Loychuk. The adapter clamp 8 is hollow and encircles the power tube 12 and the liner tube 10. The adapter clamp 8 is constructed so that it enables the conventional nozzle 6, with rim 7, with the power tube 12 and the liner tube 10 inserted therein, to be mated with the curled cap rim 9 of the aerosol can 2. Specifically, the adapter clamp 8 is constructed so that it has a rim receiving lip 11 at the top thereof, and a cap rim engaging lip 13 formed in the side thereof. Lip 11 is constructed so that it receives rim 7 of nozzle 6 and can be stamped thereon in a tight fit by conventional equipment. Cap rim engaging lip 13 is constructed so that it can be stamped snuggly over curled cap rim 9 by conventional cap fastening equipment. When assembled, the power tube 12, and inner liner 10 can be filled with the liquid that is to be contained in the aerosol can 2 under pressure, and the energy thereby stored in the expanded rubber power tube 12 forces the contents of the liner tube 10 through the opening in nozzle 6 is depressed manually.

Figure 2:
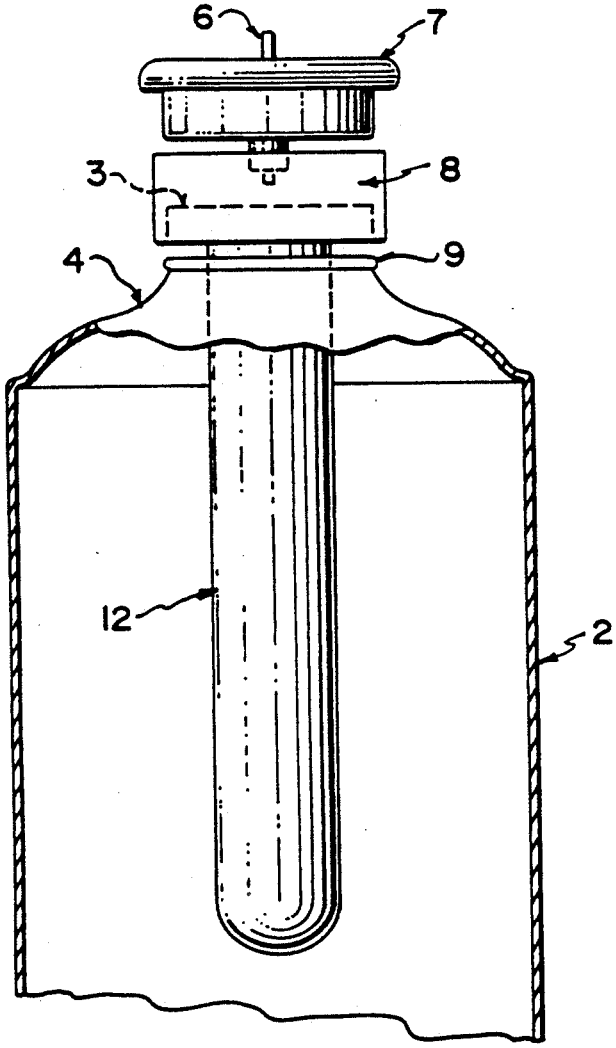
FIG. 2 illustrates a side elevation partial section view of an aerosol can, with a rubber bladder power system, a spray nozzle, and an adapter clamp connecting the nozzle and bladder to the aerosol can.

FIG. 2 illustrates a side elevation section view of an adapter 8 which represents a slight modification of the adapter illustrated in FIG. 1. However, the function of the adapter 8 remains the same. As seen in FIG. 2, the nozzle 6 and spray top rim 7 fit snuggly over the top portion of the adapter 8. Meanwhile, the base of the adapter 8 fits snuggly over curled cap rim 9 of can 2. The power tube 12, with its upper flange 3 held in place by adapter 8, contains the liquid contents which fill the aerosol can 2 and store energy in the power tube 12, when the contents are injected into the interior of the power tube 12 under pressure. The stored energy provides the force required to expel the liquid contents through nozzle 6, when nozzle 6 is depressed.

Figure 3:
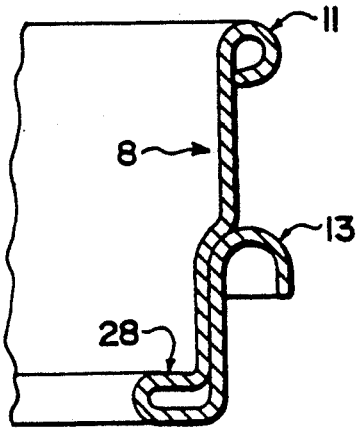
FIG. 3 illustrates a side elevation view of one side of an adapter clamp formed of metal.

FIG. 3 illustrates a side elevation section view of one side of an adapter 8 formed of metal. The metal adapter 8 can be formed by conventional metal stamping equipment. The adapter 8 is formed so that it has an upper rim receiving lip 11, and a cap rim engaging lip 13, on the outer circumference thereof. An inner base lip 28 is formed at the base interior of the adapter 8. Inner lip 28 provides a surface upon which the flange 3 of power tube 12 can securely rest.

Figure 4:
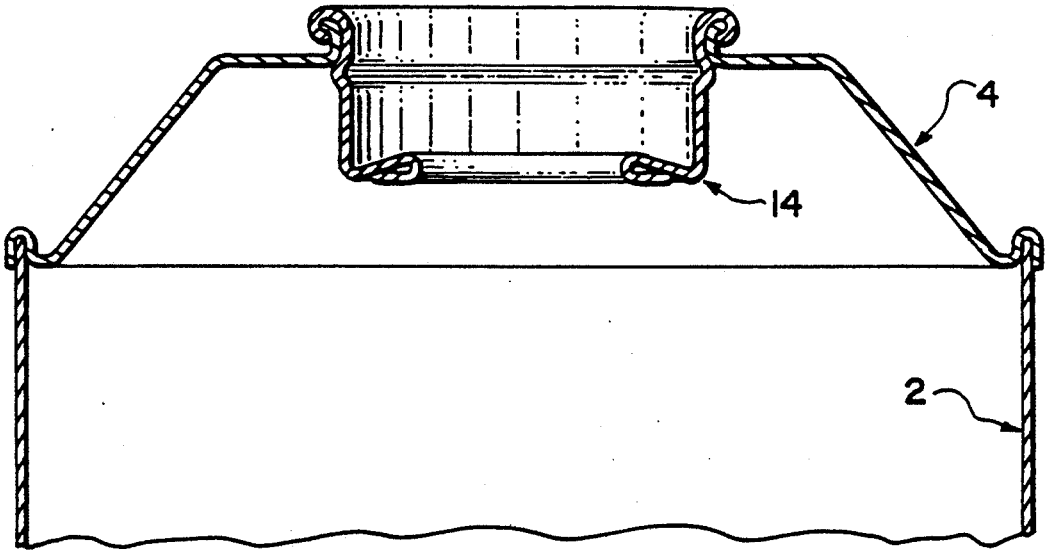
FIG. 4 illustrates a side elevation section view of the top portion of an aerosol can, with a counter-sunk well formed in the top portion of the can.
Figure 5:
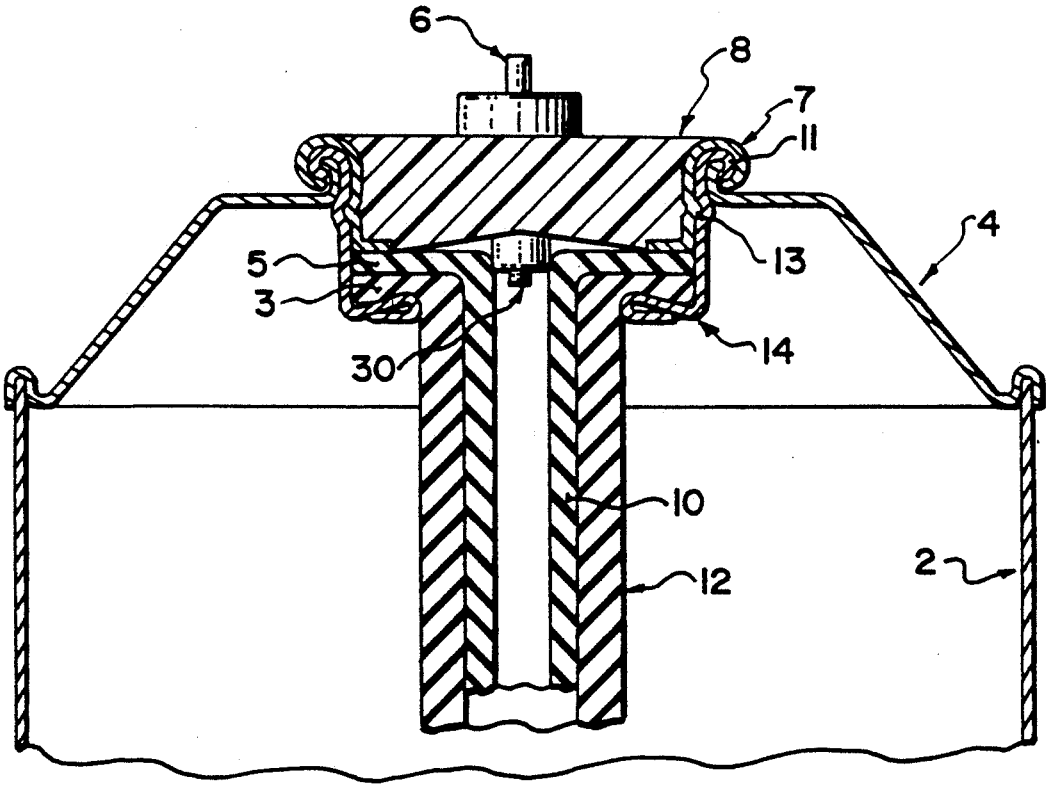
FIG. 5 illustrates a side elevation partial section view of a counter-sunk well aerosol can including a nozzle, an adapter clamp, and a bladder-liner rubber aerosol power tube system.

FIGS. 4 and 5 illustrate a variation of the adapter 8, that is designed to accommodate a construction where the nozzle 6 and rim 7 are counter-sunk in a well 14 in the can cap 4. The construction the adapter 8 is basically the same as in the construction shown in FIGS. 1, 2 and 3, in that it has a rim receiving lip 11 formed in the top thereof, and a cap rim engaging lip 13 formed in the exterior side region thereof. It also has a base inner lip 28 formed at the bottom thereof. The advantage of the adapter 8 illustrated in FIG. 5 is that the adapter 8 does not project substantially above the top of cap 4. For various reasons, the aerosol can manufacturer may wish to have the nozzle 6 and rim 7 counter sunk in the well 14 of the cap 4, rather than projecting above the top of the can cap 4, as illustrated in the adapter construction depicted in FIGS. 1, 15 2 and 3. If desired, the base of the nozzle 6 (indicated by lead-line 30) can be positioned to fit snuggly in the opening in the upper flange 5 of liner 10, and thereby provide a seal between the nozzle base 30 and the flange 5 of the liner tube 10.

Figure 6:
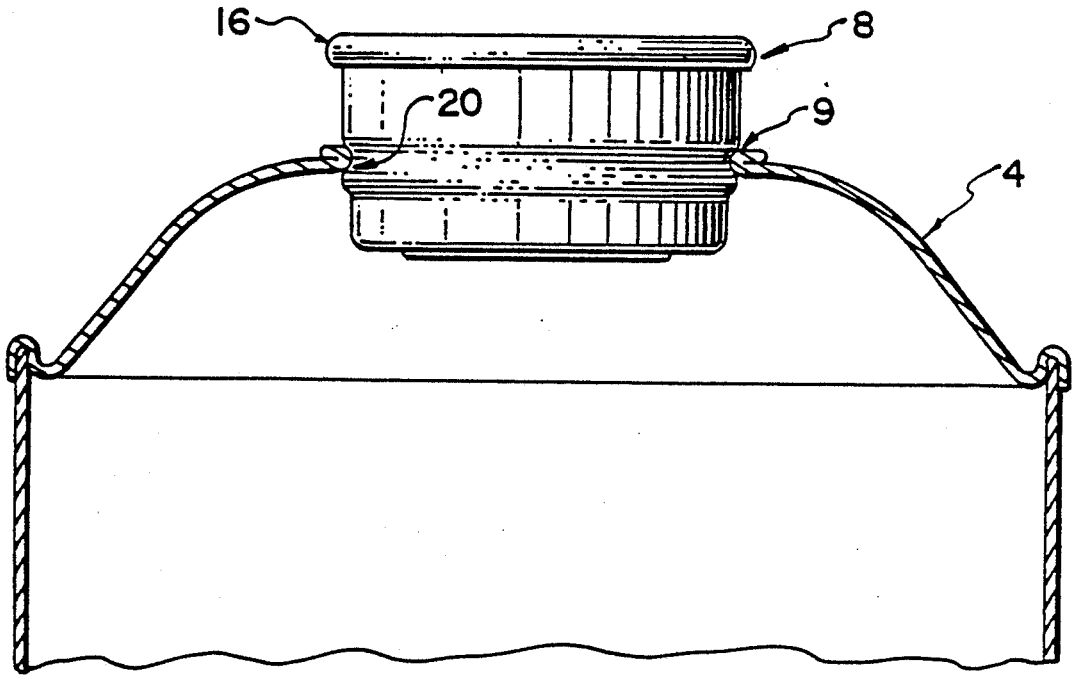
FIG. 6 illustrates a side elevation section view of an adapter clamp which can fit into the curled top opening of a conventional aerosol can and provide a clip seal with the can.
Figure 7:
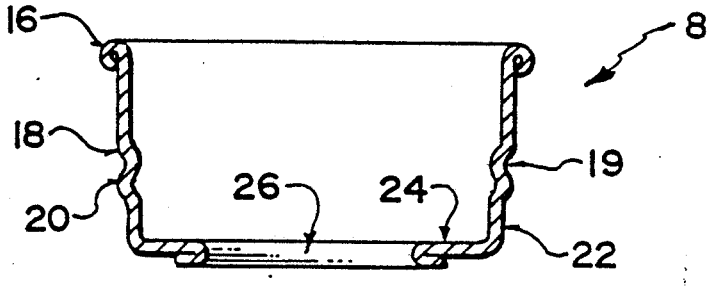
FIGS. 7, 8 and 9 depict respectively side section, top and bottom views of the adapter clamp illustrated in FIG. 6 above.
Figure 8:
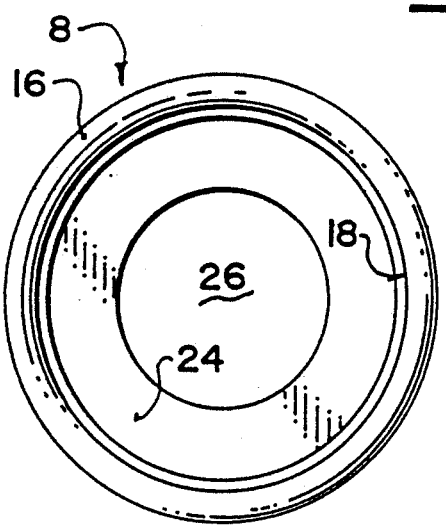
Figure 9:
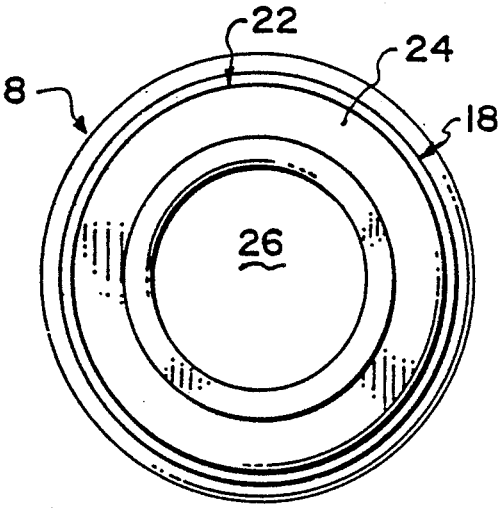

FIG. 6 illustrates in side elevation view a modified adapter 8, which is designed to project partially above can cap 4, and snap into a snug fit within the curled cap rim 9 surrounding the opening in the cap 4. The adapter 8 has the same basic construction as illustrated in previous embodiments, (See FIGS. 1 to 5) in that it has an upper rim receiving lip 16, a ridge and recessed region 20 formed in the exterior mid-region of the outer wall of the adapter 8. This recess 20 is adapted to mate snuggly with rim 9 of the opening in the can cap 4. The adapter 8 depicted in FIG. 6 is illustrated in more detail in side elevation section view (FIG. 7), top view (FIG. 8) and bottom view (FIG. 9). As seen in FIGS. 7, 8 and 9, the adapter 8 has a lip 16 formed at the top edge of the adapter 8. The adapter 8, as illustrated in FIGS. 6, 7, 8 and 9, is constructed so that it has an upper shoulder 18 which in conjunction with ridge 20, forms a groove 19 surrounding the mid-region of the adapter 8. Groove 19, in co-operation with shoulder 18, and ridge 20, is designed to mate snuggly with cap rim 9 encircling the opening in cap 4 of the aerosol can 2. The ridge 19 rests above a lower shoulder 22, which transforms smoothly into bottom ledge 24. Bottom ledge 24 has formed therein a circular hole 26 which receives the power unit of the aerosol. In the case of power tube 12, and liner 10, the annular bottom surface 24 receives the upper flanges 3 and 5 of the power tube 12 and liner tube 10 respectively.

Figure 10:
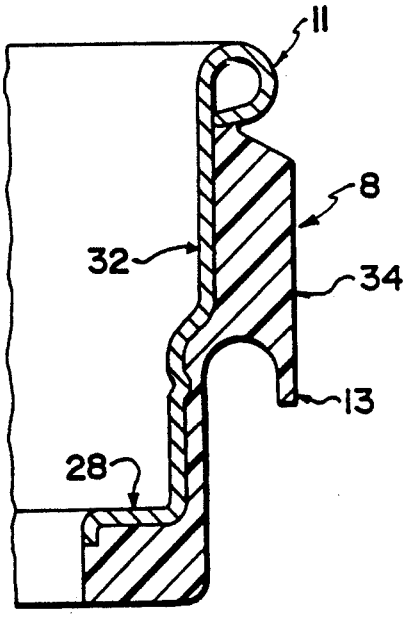
FIG. 10 illustrates a side elevation partial section view of an adapter clamp constructed of metal and plastic.

FIG. 10 illustrates an adapter design 8 which resembles the adapter design depicted in FIG. 3, except that it is formed so that it has a metal inner liner 32 and a plastic outer liner 34. The metal-plastic combination adapter 8, as illustrated in FIG. 10, is formed so that it has an upper rim receiving lip 11 at the top, and a cap rim engaging lip 13 formed around the exterior mid-region of the adapter 8. The inner lip 28 is formed inwardly at the base thereof to define an opening in the base of the adapter 8. Inner lip 28 is adapted to receive and seat the flange 3 of power tube 12, or the flanges 3 and 5 of a power tube 12 and liner tube 10 combination.

Figure 11:
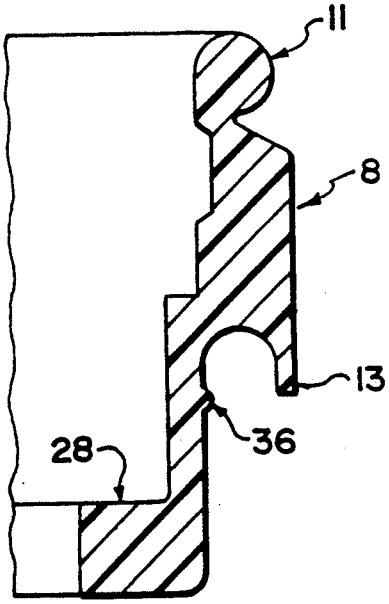
FIG. 11 illustrates a side elevation partial section view of an adapter clamp formed of plastic.

FIG. 11 illustrates an adapter 8 which is entirely formed of plastic. The adapter 8 as illustrated in FIG. 11 may be formed of injection moulded polyethylene, polypropene, or some other suitable polymer. Similar to the construction of the metal adapter 8 illustrated in FIG. 3, the all plastic adapter 8 illustrated in FIG. 11 has a rim receiving lip 11 at the top thereof, a cap rim engaging lip 13 formed in the exterior mid-region of the adapter 8, and an inner lip 28 formed at the bottom inner region of the adapter 8. To provide a snap fit capability for the lip 13, a small ridge 36 is formed around the circumference of the exterior surface of the adapter 8, adjacent the lip 13. Cap rim 9 can then be snapped-fitted into the hollow created by the lip 13 on one side, and the ridge 36 on the other side.

The adapter, as depicted in FIGS. 1 to 11, has been tested on a variety of bladders and at a variety of pressures and has been found to perform well in all cases. The adapter seals all openings as soon as pressure is applied and it does not allow leakage of any of the liquid contents. This adapter is a separate unit from the can and the bladder.

The first variant of the adapter (See FIGS. 1, 2 and 3) forms a highly visible collar on the aerosol can 2. This offers advantages from a marketing point of view, because it can be used to highlight the particular product in the aerosol and especially the fact that the aerosol is bladder driven rather than by fluorochloro-carbon, or any other gas that is harmful to the environment.

The adapter is unique in that it permits for the first time all bladder type dispensers to be filled with "under the lid" equipment, slightly modified for pumping liquid product. This allows the use of standard, cost effective existing cans and valves to be used. Because the adapter is universal for different valves, cans and bladders, production flexibility and instant construction of custom containers are easily available to manufacturers to accommodate efficiently marketing and sales requirements. The adapter also offers the advantage of being visible to the end user and thereby acting as a flag of differentiation from the competition.

A secure mechanical seal is created by the large surface area collar provided on the rubber or plastic tubes of most existing bladder dispensers in combination with the adapter. The adapter performs properly over a wide range of pressures. It seals instantly when pressure is applied to the container and does not allow the escape of any product in the process. The adapter, if required, also allows filling of the can to take place by a "through the valve" method if the dispenser is crimped before filling.

EXAMPLE 1

Assembly and Test Filling of Prototype Dispenser System

1. A "STANDARD" aerosol can i.e. spray can was used.

2. The steel adapter was placed over a rubber tube and the flanged washer end of the rubber tube was tucked into the steel adapter.

3. Sealant was placed on the top rim of an empty jumbo can.

4. The steel adapter with the tube was pushed into the can and the adapter pressed firmly onto the can rim thereby making a good seal for "under the lid" sealing.

5. The valve assembly was placed loosely on the top of the can and adapter.

6. The unit was then sent through blockhouse filling equipment (i.e. for filling and sealing).

7. Instead of filling with propellant and gas, the can was filled with a liquid product blended for direct use.

8. The large flat surface of the rubber washer flange on the rubber tube was found to seal 100% when subjected to the pressure of filling the can with liquid product.

9. Filling speeds and pressures were kept as low as possible initially and product temperatures were held close to room temperature initially.

10. The adapter lips, once the can was filled, were crimped and sealed. No leaks were apparent.

As will be apparent to persons skilled in the art, various modifications and adaptations of the structure above-described are possible without departure from the spirit of the invention, the scope of which is defined in the appended claims.

I claim:

1. A hollow adapter of generally cylindrical shape suitable for enabling a nozzle to be fitted to the top of an aerosol can comprising:

(a) rounded ridge means formed around the top of the adapter, said ridge means being adapted to mate with a rim of an aerosol nozzle;

(b) lip means formed on the exterior surface of the adapter at a location below the ridge means, said lip means being shaped to form between it and the wall of the adapter a receptacle adapted to mate with a rim surrounding the opening in the top of an aerosol can; and (c) base means at the base of the adapter extending to a hollow interior of the adapter, said base means having an opening therein, and being adapted to receive in bearing support thereon the upper open region of an open-ended bladder adapted to contain and power through the nozzle a liquid contained in the bladder.

2. An adapter as claimed in claim 1 wherein a grove is formed in the exterior circumference of the mid-region of the adapter.

3. An adapter as claimed in claim 2 wherein the groove is located below the lip means.

4. An adapter as claimed in claim 1 wherein a ridge is formed in the exterior surface of the mid region of the adapter.

5. An adapter as claimed in claim 4 wherein the ridge is located below the groove.

6. An adapter as claimed in claim 1 wherein the base means is a circular horizontal platform extending around the interior wall of the base of the adapter.

7. An adapter as claimed in claim 1 wherein a shoulder is located in the mid-region of the interior of the adapter and extends around the interior of the adapter.

* * * * *